US005123979A

United States Patent [19]

Tenaud et al.

[11] Patent Number: 5,123,979

[45] Date of Patent: Jun. 23, 1992

[54] ALLOY FOR FE ND B TYPE PERMANENT MAGNET, SINTERED PERMANENT MAGNET AND PROCESS FOR OBTAINING IT

[75] Inventors: Philippe Tenaud, Crolles; Fernand Vial, Meylan, both of France; Masato Sagawa, Kyoto, Japan

[73] Assignee: Aimants Ugimag SA, St. Pierre D/Allevard, France

[21] Appl. No.: 617,648

[22] Filed: Nov. 26, 1990

[30] Foreign Application Priority Data

Dec. 1, 1989 [FR] France ..... 89 16732

[51] Int. Cl.[5] ..... H01F 1/053

[52] U.S. Cl. ..... 148/302; 420/83; 420/121

[58] Field of Search ..... 148/302; 420/83, 121

[56] References Cited

U.S. PATENT DOCUMENTS 4,601,875 7/1986 Yamamoto et al. ..... 148/302
5,015,307 5/1991 Shimotomai et al. ..... 148/302

FOREIGN PATENT DOCUMENTS 0311049 4/1989 European Pat. Off. ..... 148/302
63-111602 5/1988 Japan ..... 420/83
63-115304 5/1988 Japan ..... 420/83

*Primary Examiner*—John P. Sheehan
*Attorney, Agent, or Firm*—Dennison, Meserole, Pollack & Scheiner

[57] ABSTRACT

The invention relates to Fe Nd B type alloys for permanent magnets, the permanent magnets thus obtained and a method of producing them.

They have high magnetic characteristics with good temperature resistance and good resistance to atmospheric corrosion.

They comprise, in at%, 12 to 18% of rare earths, 3 to 30% of Co, 5.9 to 12% of B, 2 to 10% of V, some Al and Cu, the remainder being iron and unavoidable impurities. The V can be substituted by other refractory elements (Nb, W, Cr, Mo, Ti, Zr, Hf, Ta).

The method mainly involves sintering at between 1050 and 1110° C. followed by annealing at between 850 and 1050° C. and/or artificial ageing at between 560° C. and 850° C.

14 Claims, 1 Drawing Sheet

Figure 1:
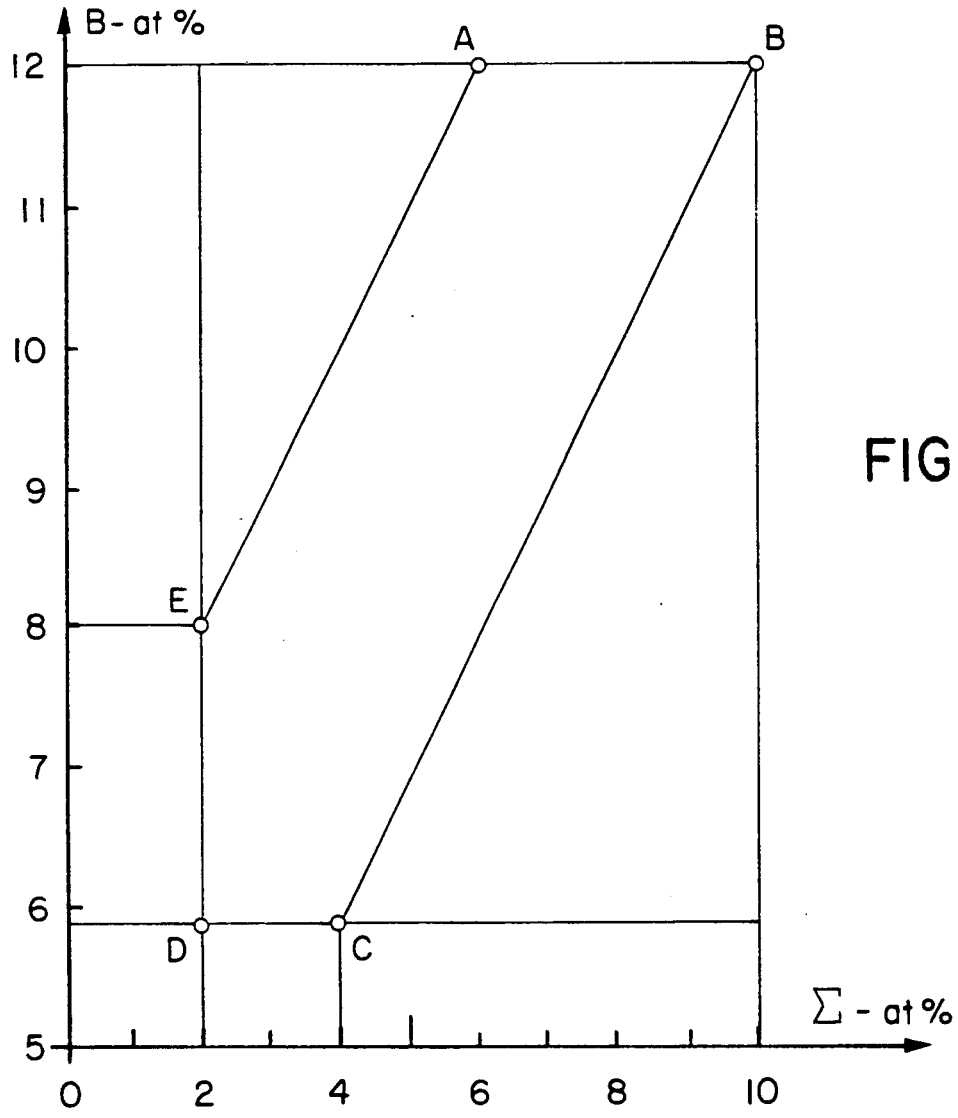

ALLOY FOR FE ND B TYPE PERMANENT MAGNET, SINTERED PERMANENT MAGNET AND PROCESS FOR OBTAINING IT

The invention relates to alloys for permanent magnets belonging to the family of Fe Nd B, the corresponding sintered magnets and a process for obtaining them.

It is known that Fe Nd B type magnets, despite having high magnetic properties, in particular the combination of high values of intrinsic coercive force ($H_{cJ}$), residual magnetism (Br) and specific energy (BH) max, have limitations in use owing, in particular, to their high temperature coefficients which, in practice, limit their use to 100° to 150° C., to their low Curie point and to their limited resistance to oxidation and corrosion.

The increase in $H_{cJ}$ and the reduction in the temperature coefficient has been researched by addition of heavy rare earths, in particular dysprosium in partial substitution of the Nd. This forms the subject, for example, of the patent application EP-A-0134305. However, this rare earth is scarce and expensive.

The addition of Al has also been employed to increase the wettability of a phase which is rich in rare earths and is present in the alloy to facilitate dispersion thereof and obtain higher values of $H_{cJ}$, at least at low temperatures.

Moreover, additions of Cu have been made in this family of alloys but have led to poor metallurgical and magnetic properties (see CH. ALLIBERT, Concerted European Action on Magnets, Elsevier Applied Sciences London 1989 p358).

The addition of Co as a replacement for the iron has a positive effect on the increase in the Curie point, from which better temperature resistance of the magnet characteristics can be expected and better resistance to atmospheric corrosion can also be obtained.

However, all these improvements are still insufficient for uses at high temperature and/or in hostile environments.

The invention allows the current limitations of Fe Nd B type alloys to be exceeded while maintaining good magnetic properties at ambient temperature.

The alloys according to the invention have the following chemical composition (in at%):

| | |
|---|---|
| Rare earths (TR) | 12 to 18% |
| Co | 3 to 30% |
| B | 5.9 to 12% |
| V | 2 to 10% |
| with 0.7 < Al < 1.2 and 0.01 < Cu < 0.2% | |
| or | |
| Al < 1.2% and 0.01 < Cu < 0.05% | |
| Remainder Fe and unavoidable impurities. | |

The term rare earths covers one (or more) of the elements of the lanthanides family (atomic numbers Z ranging from 57 to 71) to which the Y (Z=39) is assimilated. Some of these rare earths can be provided by misch-metal, didymium, or other compounds or mixtures containing them.

The V can be completely or partially substituted by one (or more) of the following elements: Ti, Cr, Nb, Mo, W to a total content of 6 at%. It can be partially substituted to 50% (in atoms) by one (or more) of the following elements: Zr, Hf, Ta, that is a total of 1 to 5 at%.

The Al can be completely or partially substituted by one or more of the following elements: Si, Ga, Mn, Zn, Ni.

The preferred compositions are as follows, taken individually or in combination; it is preferable for the contents of rare earths to be between 13.6 and 15.5 at%, that the content of V (or other refractory elements) is between 2.5 and 5 at%, that the content of Cu is between 0.02 and 0.04 at%, that of Al is greater than 0.1% or preferably 0.5% and that the content of B increases correlatively with the content of refractory elements (Σ), in proportions within the ABCDE polygon of coordinates:

| | | |
|---|---|---|
| A: | Σ = 6 | B = 12 |
| B: | Σ = 10 | B = 12 |
| C: | Σ = 4 | B = 5.9 |
| D: | Σ = 2 | B = 5.9 |
| E: | Σ = 2 | B = 8 |
| plotted in FIG. 1. | | |

The rare earths are essentially and preferably Nd and/or Pr, and the latter can optionally be substituted by at least one of the heavy rare earths selected from the group: Dy, Tb, Ho to a total of 5 at%.

The main impurities must be kept within the following limits: 0≦4 at%, N≦4.5 at%, C≦3 at%.

The following maximum values of other impurities can be tolerated:

Bi, Ca, Ge, Mg, Sn, up to 1 at% respectively.

Cl, F, P, S, Sb should be kept as low as possible, preferably in a total quantity below 1 at%.

The microstructure of the magnet thus obtained is made up of:

magnetic grains having a size of between 1 and 20 μm of $TR_2$ $TM_{14}$ B compound (TM is a transition metal such as Fe, Co, Ni. . .).

binder phase which is rich in TR and is in a quantity which is as small as possible and as well dispersed as possible and contains, in particular, a proportion of added Al and Cu.

phase containing the majority of the refractory elements and having a composition close to $M_2$ TM $B_2$ (for example for M=V, Mo) or M TM B (for example for M=Nb, W) or M Bx, x having a value of, for example, 2 for the compound Zr $B_2$. In the structure obtained, these phases bridge the magnetic grains and consolidate their mechanical bonds.

optionally TR My type phase, in particular if Co is added, y having a value of, for example, 2 in the case of the compound Nd $(Fe,Co)_2$.

The various phases are encountered in the following proportions by weight:

2 to 14% of $M_a MT_b B_c$ 3 to 15% of TR-rich phase 0 to 7% of TR $TM_2$ 64 to 95% of $TR_2$ $TM_{14}$ B (phase $T_1$)

and optionally a small proportion of $TR_{1+\epsilon}TM_4 B_4$.

Below TR=12 at%, the quantity of TR-rich binder phase is insufficient: the coercivity is low, less than 13 kOe (1040 kA/m). It is also difficult to densify the green compact by the currently employed method of sintering in the liquid phase. Above 18 at%, the TR-rich phase which is very corrodable, is too large; this results in low resistance in an oxidising medium. Furthermore, the residual magnetism is reduced since this phase is only very slightly magnetic.

Cobalt enters the $TR_2TM_{14}B$ phase; it raises its Curie point but significantly decreases its magnetisation, particularly in contents ≧30 at%. Furthermore, it forms compounds which improve the corrosion resistance of the material; a content ≧3% is desirable for this.

Vanadium, and more generally the M refractories used, serve to form precipitates having the composition $M_aTM_bB_c$ which bridge the magnetic grains. The coercivity increases because the enlargement of the magnetic grains during sintering is controlled and limited. Furthermore, it is believed that bridging between $TR_2TM_{14}B$ grains limits the diffusion of oxygen through the very oxidisable TR-rich phase. Below V=2 at%, the dispersion of the precipitates is insufficient; above V=10 at%, the residual magnetism decreases substantially due to the effect of addition of phases which are only slightly magnetic or are amagnetic.

Below B=5.9 at%, the formation of a large quantity of the magnetic phase $TR_2MT_{14}B$ is difficult; beyond B=12 at%, a non-magnetic $TR_{1+\epsilon}TM_4B_4$ type phase is formed, reducing the residual magnetism.

The optimum boron content is essentially determined by that of the refractories. Below B at% = 2+V at%, the precipitation of primary iron or the formation of the $TR_2TM_{17}$ phase is frequently observed and generally leads to fairly low coercivity. Above B at% = 6+V at%, the $TR_{1+\epsilon}TM_4B_4$ phase can be formed in an abundant quantity. The residual magnetism is then reduced because this phase is non-magnetic.

It is said that the Al increases the wettability of the TR-rich phase. It can be believed that the role of the copper is also to improve dispersion of this phase. Below 0.7 at% of Al combined with 0.01% of Cu, it has been found that the sintering temperatures allowing complete densification of the green compact are high; this results in a great enlargement of the magnetic grains and therefore a loss of coercivity. Above 1.2% of Al combined with 0.2% at of Cu, these elements precipitate and reduce the residual magnetism (non-magnetic additions). The copper's effect as a densifying agent virtually stops increasing for Cu ≧ 0.2 at%. It is noteworthy and surprising that small quantities of copper combined with refractory elements lead to a favourable structure not found with Al alone.

Unavoidable impurities can be tolerated:

The oxygen which forms oxides, in particular the compound $TR_2O_3$, renders a proportion of the rare earths inactive. A content ≦4 at% is therefore desired. However, it may be worthwhile in certain cases, particularly if it reinforces the passivation the TR-rich phase. A minimum content of 0.2 at% is desirable for this purpose.

Similarly, the nitrogen can be between 4.5 at% and 0.02 at%.

The carbon originates, on the one hand, from the impurities in the raw materials used and, on the other hand, from the possible voluntary additions of lubricant. The total carbon content can be between 0.02 at% and 3 at%.

The materials having the above-mentioned compositions can be shaped by various conventional processes such as rapid quenching for obtaining bound magnets and for manufacturing magnets densified by hot compression, hot deformation of ingots or powders, mechanical alloying or powder metallurgy, the starting alloys being prepared, for example, by fusion or co-reduction/diffusion.

Powder metallurgy which involves the following main operations is a preferred method:

casting of an alloy, pre-grinding by mechanical means or by hydrogen crackling, fine grinding with a jet mill, mechanically or otherwise, consolidation into solid magnets by cold compaction (in a field or otherwise) of these powders, high temperature sintering final heat treatment comprising one or more stages, grinding to the desired dimensions and tolerances.

However, to obtain the following properties: Br (20° C.) ≧ 1.1 T; $H_{cJ}$ (20° C.) ≧ 1040 kA/m; (BH) max (20° C.) ≧ 210 kJ/m3; $H_{cJ}$ (150° C.) ≧ 250 kA/m; $\mu < 1.15$, and improved corrosion resistance relative to the prior art, these operations have to be carried out under the particular conditions explained below: (the parameter $\mu$ is the slope of the reverse straight line, the index of rectangularity of the cycle, the closer the value $\mu$ is to 1, the higher the index of rectangularity of the cycle is in the B-H system).

By way of example, these operations can be carried out in the following manner:

Casting: the alloys are prepared by melting pre-alloys and pure elements at a temperature of between 1250° and 1800° C., preferably between 1350° and 1700° C. and are cast in the form of ingots.

Homogenisation: homogenisation in a non-oxidising atmosphere is carried out, if necessary, by means of a treatment effected on the ingots at between 850° and 1120° C., preferably between 1000° and 1100° C., for a period ranging from 30 minutes to 24 hours.

Pre-grinding: it can be carried out by mechanical means to a size of 100 to 1000 μm, but also by H2 crackling; in this case, the ingots are subjected to a hydrogen charge at a pressure of between 1 atm (absolute) and 2 atm (absolute) at a temperature below 250° C. in order to embrittle them and to splinter them completely owing to the formation of one or more hydride (s) including at least those of rare earths alone or alloyed. A treatment is then carried out under vacuum at a pressure below 1 Pa and in a temperature range of between 400° C. and 600° C. for a period ranging between 2 and 24 hours with a view to its partial dehydration, the embrittlement of the fine powdered material taking place and being completed during this treatment.

Fine grinding: the pre-ground material is then ground in a nitrogen jet mill of which the parameters are adjusted so as to obtain a powder having the following grain size distribution, by weight:

$$1 < D_{10} < 4\ \mu m$$

$$3 < D_{50} < 15\ \mu m$$

$$5 < D_{90} < 40\ \mu m$$

(Dx represents the maximum size of the particles having a fraction by weight of x%).

Compression: the green compacts are compressed in the tools of a press with or without application of a magnetic field (producing induction ranging from 0.3 to 2.5 Tesla continuously or up to 6 Tesla in a pulsed field) applied parallel or perpendicularly to the direction of compression under a pressure which can vary between 160 and 580 MPa, preferably between 180 and 300 MPa, or again under a hydraulic press in the case of isostatic compression with or without prior orientation of the powder.

Sintering: sintering is carried out under vacuum or under partial pressure of inert gas (pressure ≦ 0.1 Pa absolute), at a temperature between 1050° and 1110° C. and preferably between 1070° and 1090° C. for a period of between 30 minutes and 8 hours, followed by cooling, of which the mean rate between the final sintering temperature and 300° C. is ≧ 20° C./min.

Annealing/artificial ageing

One or more heat treatments are carried out, depending on the compositions of alloy and the desired properties. In the case of a double treatment (case, for example, of composition no. 4 below), the procedure is as follows:

A first annealing treatment is carried out under vacuum or under partial pressure of inert gas at a temperature of between 850° and 1050° C., preferably between 900° and 1000° C. for a period of 30 minutes to 4 hours followed by cooling at a mean rate ≦ 20° C./min to 300° C.

A second treatment is then carried out at a temperature of between 550° and 800° C. depending greatly on the composition, preferably between 600° and 700° C., followed by cooling at a mean rate ≦ 50° C./min to 300° C.

These operations can be carried out continuously or intermittently after sintering.

Figure 2:
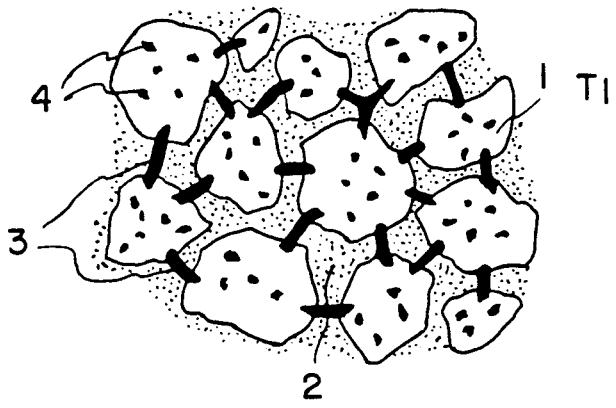

The invention will be understood better with the aid of the following examples illustrated by FIGS. 1 and 2.

FIG. 1 shows the optimum correlation between the contents of B and refractory elements of the compositions according to the invention.

FIG. 2 shows schematically the structure of a sintered magnet according to the invention. It has a microstructure in which the principal phase (1) is made up of grains of phase T1 ($TR_2TM_{14}B$) bound by a phase (2) which is rich in TR and by precipitates (3) of phase $M_aTM_bB_c$ forming bridges between the grains (1). These precipitates also exist in dot form (4) in the grains (1).

EXAMPLES 1, 2 and 3 (prior art)

Alloys having the following composition (in at%) obtained from electrolytic Fe and Co, Al, Cu and ferro-alloys Fe-Nd, Fe-Dy, Fe-B and Fe-V.

| No. | Nd | Dy | Co | V | B | Al | Cu | Fe |
|---|---|---|---|---|---|---|---|---|
| 1 | 14.3 | 0.7 | 5 | — | 8 | 1 | — | remainder |
| 2 | 15 | — | 5 | 3 | 7 | 0.75 | — | remainder |
| 3 | 16 | — | 5 | 3 | 7 | 0.75 | — | remainder |

The ingots were crackled with hydrogen then ground, compressed with a field parallel to the axis of compression, sintered and subjected to a double treatment: 800° C./1h + 620° C./1h for (1), 950° C./1h + 680° C./1h for (2 and 3).

The results obtained are shown in Table I.

EXAMPLE 4 (according to the invention)

An alloy having the following atomic composition was prepared from electrolytic Fe and Co, Cu, Al and ferro-alloys Fe-V, Fe-Nd and Fe-B:

| Nd: 15 | Co: 5 | B: 7 | V: 3 | Al: 0.75 | Cu: 0.03 | Fe: remainder |
|---|---|---|---|---|---|---|

which was cast at 1300° C. into ingots, pre-ground by hydrogen crackling at ambient temperature at a pressure of 1.2 atm ($1.2 \times 10^5$ Pa) then treated under vacuum for 4 hours at 450° C.; the powder obtained has a size smaller than ≃1 mm; the products obtained were then ground by a nitrogen jet mill to obtain a powder having grain sizes of between 0.5 and 30 μm and possessing a Fisher granulometric mean of 4 μm (FSSS). The powder was compressed in the form of 12 × 10 mm ϕ cylinders in a hydraulic press at 280 MPa, with application of a magnetic field producing induction of 1.3 T applied parallel to the axis of compression.

The green compact was sintered at 1090° C. for 1 hour at a mean cooling rate of 30° C./min.

The sintered magnet was then treated in the following manner:

950° C. – 1 h cooling at 30° C./min
+680° C. – 1 h cooling at 60° C./min.

The characteristics obtained are as follows:

$Br = 1.13\ T$ $$\frac{d\,H_{cj}}{H_{cj}\cdot dT}\ (20\text{–}100^\circ\ \text{C.}) = -0.6\%\ \text{K}^{-1}$$

$H_{cJ} = 1320$ kA/m $(BH)\max = 258$ kJ/m3 $\quad \frac{d\,H_{cj}}{H_{cj}\cdot dT}\ (20\text{–}180^\circ\ \text{C.}) = -0.51\%\ \text{K}^{-1}$ $d = 7.48$ $\mu = 1.08 \quad \frac{d\,Br}{Br\cdot dT} = -0.10\%\ \text{K}^{-1}$ $H_{cJ}$ (180° C.) = 256 kA/m These magnetic values at 20° C. are at least equivalent to those obtained for Example 1 according to the prior art, but the alloy according to the invention has much better temperature resistance, without the use of Dy, as shown in Table II.

Moreover, the magnets relating to this example are free from rust coloured spots which are visible to the naked eye after 150 h of residence in a wet chamber at 90% relative humidity and at 80° C. On the other hand, spots appear on alloy no. 1 after about 10 h under the same conditions.

EXAMPLE 5 (ACCORDING TO THE INVENTION)

Alloys 4 to 18 were prepared and treated as the alloy in Example 4, sintering having been carried out at 1090° C. - 1 h and the annealing and artificial ageing treatments having been carried out within the optimum ranges specified in the text.

The results obtained are shown in Table III.

TABLE I

| No | d*** | Br (T) | (kA/m) | (BH)max (KJ/m3) | dBr/Brxdt (% K⁻¹) | diHC/iHCxdT (% K⁻¹) | Corr **** |
|---|---|---|---|---|---|---|---|
| 1 | 7.52 | 1.13 | 1274 | 236 | −0.14 | −0.66 (20/100° C.) | A |
| 2a* | 7.21 | 1.08 | 1274 | 216 | −0.10 | −0.55 (20/180° C.) | B |
| 2b** | 7.47 | 1.13 | 960 | 236 | −0.10 | −0.55 | C |
| 3 | 7.48 | 1.07 | 1274 | 212 | −0.10 | −0.55 | B |

*(a) sintering at 1060° C.
**(b) sintering at 1100° C.
***d density
****A very sensitive
B sensitive
C only slightly sensitive

TABLE II

| | T (°C.) | 20 | 100 | 180 |
|---|---|---|---|---|
| TEST 1 | Br (T) | 1.15 | 1.04 | 0.93 |
| | HcJ (kA/m) | 1274 | 473 | 143 |
| TEST 4 | Br (T) | 1.13 | 1.04 | 0.95 |
| | HcJ (kA/m) | 1320 | 668 | 256 |

| | |
|---|---|
| Rare earths | 12 to 18% |
| Co | 3 to 30% |
| B | 5.9 to 12% |
| Cu | 0.01 to 0.05% |
| Al | less than 1.2% |

TABLE III

| No | COMPOSITION (at %) Nd | Co | B | V | Al | Cu | Br (T) | HcJ (kA/m) | (BH)max (kJ/m3) | μ | d# | Tc (°C.) | Corr.## (h) |
|---|---|---|---|---|---|---|---|---|---|---|---|---|---|
| 4 | 15 | 5 | 7 | 3 | 0.75 | 0.03 | 1.13 | 1320 | 258 | 1.08 | 7.48 | 350 | 200 |
| 5 | 15 | 5 | 8 | 4 | 0.75 | 0.03 | 1.10 | 1310 | 224 | 1.08 | 7.46 | 350 | 300 |
| 6 | 15 | 0 | 7 | 3 | 0.75 | 0.03 | 1.13 | 1280 | 240 | 1.08 | 7.44 | 310 | 150 |
| 7 | 15 | 20 | 7 | 3 | 0.75 | 0.03 | 1.10 | 1160 | 224 | 1.09 | 7.65 | 450 | 400 |
| 8 | 15 | 5 | 8 | Nb = 4 | 0.75 | 0.03 | 1.10 | 1240 | 224 | 1.08 | 7.52 | 350 | 300 |
| 9 | 15 | 5 | 8 | W = 4 | 0.75 | 0.03 | 1.10 | 1240 | 224 | 1.08 | 7.89 | 350 | 300 |
| 11 | 15 | 5 | 8 | V = 3<br>Ti = 1 | 0.75 | 0.03 | 1.10 | 1240 | 224 | 1.08 | 7.44 | 350 | 300 |
| 12 | 15 | 5 | 8 | V = 3<br>Nb = 1 | 0.75 | 0.03 | 1.10 | 1280 | 224 | 1.08 | 7.46 | 350 | 300 |
| 13 | 15 | 5 | 8 | V = 3<br>W = 1 | 0.75 | 0.03 | 1.10 | 1240 | 224 | 1.08 | 7.46 | 350 | 300 |
| 14 | 15 | 5 | 7 | V = 2<br>Nb = 1 | 0.75 | 0.03 | 1.10 | 1240 | 240 | 1.08 | 7.51 | 350 | 200 |
| 15 | 15 | 5 | 7 | V = 2<br>Mo = 1 | 0.75 | 0.03 | 1.10 | 1200 | 240 | 1.08 | 7.52 | 350 | 200 |
| 16 | 15 | 5 | 7 | V = 2<br>Cr = 1 | 0.75 | 0.03 | 1.10 | 1200 | 240 | 1.08 | 7.52 | 340 | 200 |
| 17 | Nd = 14.3<br>Dy = 0.7 | 5 | 7 | V = 3 | 0.75 | 0.03 | 1.08 | 1600 | 216 | 1.07 | 7.54 | 352 | 200 |
| 18 | Nd = 13.5<br>Dy = 1.5 | 5 | 7 | V = 3 | 0.75 | 0.03 | 1.03 | 2000 | 192 | 1.06 | 7.59 | 356 | 200 |

#d density
mean duration of appearance of rust spots in a humid atmosphere at 90% relative humidity and at 80° C.

We claim:

1. Alloy for a permanent magnet consisting essentially of in at %,

| | |
|---|---|
| Rare earths | 12 to 18% |
| Co | 3 to 30% |
| B | 5.9 to 12% |
| Al | 0.7 to 1.2% |
| Cu | 0.01 to 0.2% |

at least one refractory element selected from the group consisting of V, Nb, W, Cr, Ti, Mo, Zr, Hf, and Ta in a total amount of 2–10 at %, with Nb+W+Mo+Cr+Ti≦6 at % and $$\frac{Zr + Hf + Ta}{V + Nb + W + Mo + Cr + Ti + Hf + Zr + Ta} \leqq 0.5,$$

and remainder Fe and unavoidable impurities.

2. Alloy for a permanent magnet consisting essentially in at %,

| | |
|---|---|
| Rare earths | 12 to 18% |
| Co | 3 to 30% |
| B | 5.9 to 12% |
| Cu | 0.01 to 0.05% |
| Al | less than 1.2% |

at least one refractory element selected from the group consisting of V, Nb, W, Cr, Ti, Mo, Zr, Hf, and Ta in a total amount of 2–10 at %, with Nb+W+Mo+Cr+Ti≦6 at % and $$\frac{Zr + Hf + Ta}{V + Nb + W + Mo + Cr + Ti + Hf + Zr + Ta} \leqq 0.5,$$

and remainder Fe and unavoidable impurities.

3. Alloy according to claim 1 or 2, wherein the Al is completely or partially substituted by Si, Ga, Mn, Zn, Ni.

4. Alloy according to claim 1 or 2, wherein the impurities are limited in the following manner:

O≦4 at %

N≦4.5 at %

C≦3 at %

Be, Bi, Ca, Mg, Sn below 1 at % respectively, and Cl, F, P, S, Sb below 1 at % total.

5. Alloy according to claim 1 or 2, wherein the content of rare earths is between 13.6 and 15.5 at %.

6. Alloy according to claim 1 or 2, wherein the content of V is between 2.5 and 4 at %, the other refractory elements being limited to a total of 2.5 at %.

7. Alloy according to claim 1 or 2, wherein the content of Cu is between 0.02 and 0.04 at %.

8. Alloy according to claim 2, wherein the content of Al is greater than 0.1%.

9. Allow according to claim 1 or 2, wherein the total content Σ of refractory elements is linked to the boron content in proportions within a polygon ABCDE having coordinates:

| | | | |
|---|---|---|---|
| A | Σ = 6 | B = 12 | at % |

-continued

| | | | |
|---|---|---|---|
| B | Σ = 10 | B = 12 | at % |
| C | Σ = 4 | B = 5.9 | at % |
| D | Σ = 2 | B = 5.9 | at % |
| E | Σ = 2 | B = 8 | at % |

10. Alloy according to claim 1 or 2, wherein the rare earth is Nd.

11. Alloy according to claim 1 or 2, wherein in that the rare earth is Nd and/or Pr.

12. Alloy according to claim 11, wherein the Nd and/or Pr is substituted by at least one of the heavy rare earths selected from the group consisting of Dy, Ho, and Tb up to a total of 5 at %.

13. Magnet obtained from the alloys of claim 1.

14. Alloy according to claim 8, wherein the content of Al is greater than 0.5 at %.

* * * * *

UNITED STATES PATENT AND TRADEMARK OFFICE

CERTIFICATE OF CORRECTION

PATENT NO. : 5,123,979

DATED : June 23, 1992

INVENTOR(S) : Philippe TENAUD et al

It is certified that error appears in the above-identified patent and that said Letters Patent is hereby corrected as shown below:

Column 5, line 24, change "≦" to --≧--.

Column 5, line 30, change "≦" to --≧--.

Signed and Sealed this

Twenty-first Day of September, 1993

Bruce Lehman

*Attest:*

BRUCE LEHMAN

*Attesting Officer*

*Commissioner of Patents and Trademarks*